United States Patent [19]

Groeger

[11] Patent Number: 4,562,802

[45] Date of Patent: Jan. 7, 1986

[54] FLEXIBLE CYLINDER ENGINE

[76] Inventor: Theodore O. Groeger, 2 Collamore Cir., West Orange, N.J. 07052

[21] Appl. No.: 551,745

[22] Filed: Nov. 14, 1983

Related U.S. Application Data

[63] Continuation-in-part of Ser. No. 313,559, Oct. 22, 1981, Pat. No. 4,453,508.

[51] Int. Cl.[4] ..... F02B 53/00

[52] U.S. Cl. ..... 123/200; 123/241; 418/45

[58] Field of Search ..... 123/200, 241, 193 R, 123/193 P, 44 E, 55 A; 418/45; 92/89, 90, 92

[56] References Cited

U.S. PATENT DOCUMENTS

| | | | |
|---|---|---|---|
| 652,035 | 5/1900 | Michon | 418/45 |
| 2,581,830 | 1/1952 | Averill | 418/45 |
| 3,007,416 | 11/1961 | Childs | 92/90 |
| 3,203,356 | 8/1965 | Jepsen | 92/92 |
| 3,561,892 | 2/1971 | Achermann et al. | 92/89 |
| 3,628,898 | 12/1971 | Bragdon | 418/45 |
| 3,870,437 | 3/1975 | Gondek | 418/153 |
| 3,872,852 | 3/1975 | Gilbert | 123/44 E |
| 4,044,728 | 8/1977 | Moeller | 123/193 R |

*Primary Examiner*—Michael Koczo

*Attorney, Agent, or Firm*—Theodore O. Groeger

[57] ABSTRACT

An internal combustion engine comprising at least one flexible cylinder or semicylinder (chamber) formed from (a) at least one flexible, rectangular sheet attached to a rotor, which in turn is connected to a rotatable shaft, and (b) a pair of parallel end plates contacting the sheet's end surfaces and the engine's housing, which plates contain inlet and exhaust ports (valves) for gases and/or liquids, fuel injectors and spark- or glowplugs as well, and the cylinder's volume is periodically varied by at least one roller contacting the flexible sheet's curved surface at radial distances smaller and up to the rotor's (or chamber's) radius, thereby forcing the gases out, or into the flexible cylinder or semicylinder via the ports, respectively.

12 Claims, 8 Drawing Figures

FIG. 1a
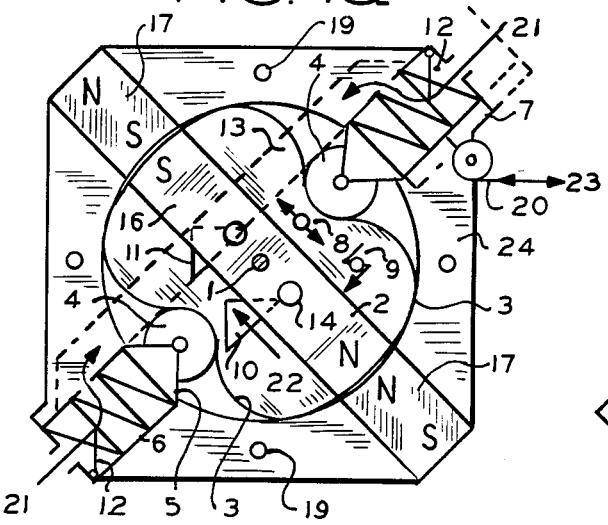
FIG. 1b
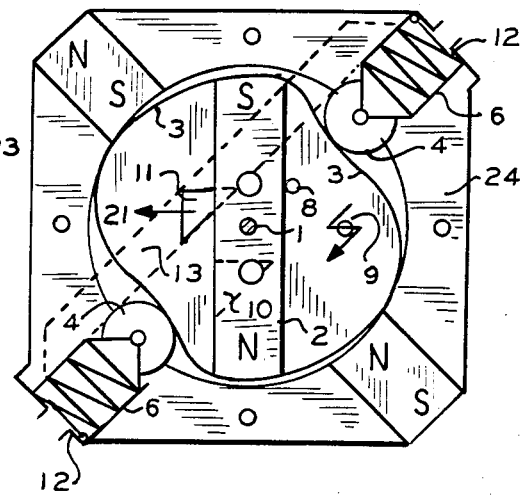
FIG. 1c
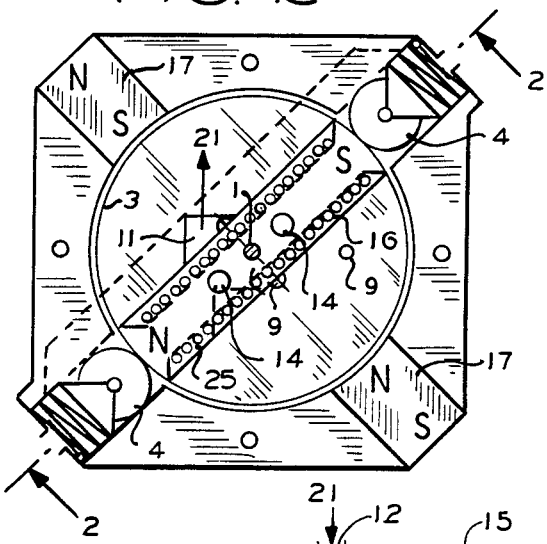
FIG. 1d
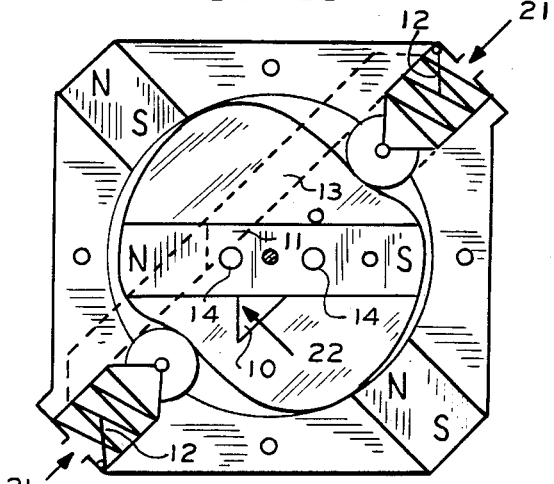
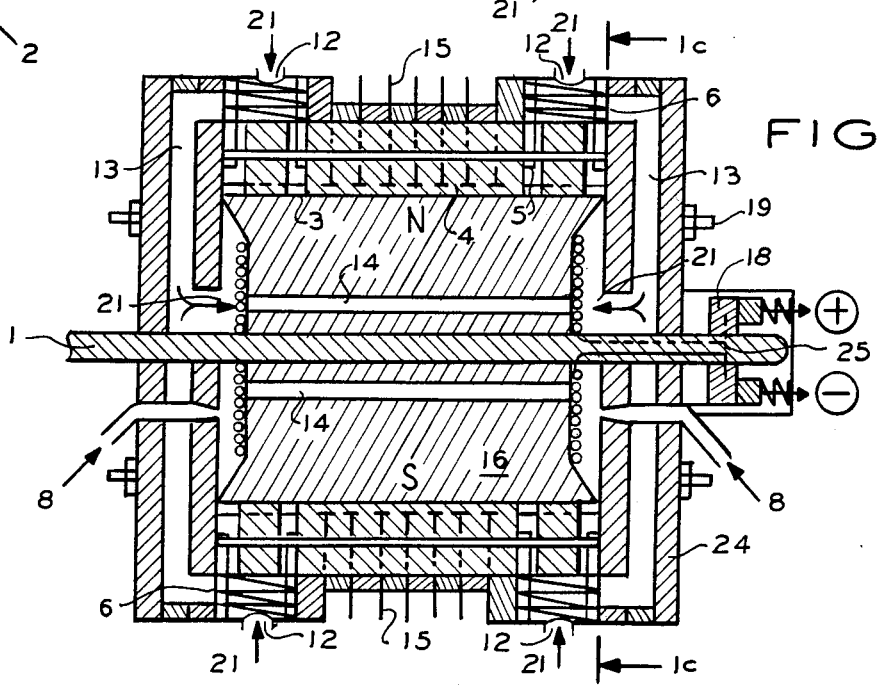
FIG. 2

FLEXIBLE CYLINDER ENGINE

CROSS-REFERENCE TO RELATED APPLICATION

This is a continuation-in-part of application Ser. No. 313,559, filed Oct. 22, 1981 now U.S. Pat. No. 4,453,508 issued June 12, 1984.

BACKGROUND OF THE INVENTION

The basic law of technology demands maximum effects to be achieved with the minimum means (July 1972 CHEMTECH, pages 390–392). Accordingly, an engine, i.e. a machine converting any energy into mechanical motion, must be: (1) running fast for optimal efficiency; (2) light for holding material and transport costs, as well as inertia, centrifugal and gyroscopic forces down; and (3) simple, in order to keep manufacturing, maintenance and repair costs low, and profits high.

Of all engines, the heat engine, especially the internal combustion engine, is utilized most widely, despite its theoretical and practical shortcomings, e.g. low efficiency and torque at appropriate temperature and speed ranges. Basically, it requires a chamber of variable volume, for which the rigid, right, circular or trochoidal cylinder with movable piston is chosen most often, in spite of the high material and manufacturing costs encountered in the precision-shaping of any body with curved surface. Therefore, both vehicle engines and power-generating turbines, and even rotary engines with flexible combustion chamber according to U.S. Pat. No. 3,872,852, contain expensive, precision-shaped parts, such as cylinder blocks and turbine blades respectively.

In contrast, the heat and pumping engines described and claimed herein, contain mainly rectangular parts, all of the surfaces thereof are either plane while manufactured, or if curved, obtained by bending or non-precision stamping and stacking of a plurality of sheets. Moreover, they permit more integrated combinations of internal combustion engine and electric motor/generator, due to similarities in the design of their essential parts. Such combinations are not yet available for the more efficient hybrid (gas-electric) vehicles, e.g. those described in the July 18, 1983 Chemical & Engineering News, page 19, or U.S. Pat. Nos. 4,011,919 and 4,165,846 respectively. However, it has been proven already that even the present-state (less integrated) hybrids offer about twice the gas-mileage of conventional cars, due to the more efficient electric drive. It yields, in contrast to the gas engine, maximum torque at low speed, and regenerative charging of the batteries while braking as well.

SUMMARY

The present invention concerns and has for its object the provision of a fast running, light and simple engine with a minimum amount of precision-shaped, rigid, curved surfaces therein. It ranges from a pump for moving gases, liquids and/or suspensions, to a heat engine, preferably an internal combustion engine, and its combination with an electric motor/generator.

Said new engine comprises, a housing, a rotatable shaft connected to a load and a rotor, at least one flexible sheet so attached to said rotor that a radial distance between the sheet's curved surface and the shaft's axis is maintained, a pair of parallel end plates mounted on said housing perpendicular to said axis and contacting said sheet's end surface, thereby forming a flexible chamber within housing sheet and plates, inlet and exhaust means within either of said end plates, a roller attached to said housing and contacting said sheet's curved surface at radial distances smaller and up to said chamber's maximum radius, and means for igniting combustible mixtures, within one of said chambers.

A cylinder, as described herein, is the surface traced by a straight generatrix (line) moving perpendicular to a closed directrix (plane curve), such as a circle, ellipse or oval, i.e. said flexible cylinder, or the walls of said chamber respectively, is/are a finite surface composed of one curved (sheet), and two plane sides (plates), centered by an axis (shaft). Said rotor is essentially the symmetrical, central part of such cylinder, trisected by two parallel planes; and the roller is a rigid, right, circular cylinder. Other conventional structures, mentioned herein, are specified in Schwarz & Grafstein's PICTORAL HANDBOOK OF TECHNICAL DEVICES, Chemical Publishing Co., New York, 1971. This invention also concerns any new part and combination of parts, disclosed herein, the process for their manufacture, as well as their use.

BRIEF DESCRIPTION OF THE DRAWINGS

FIGS. 1*a* to *d* are crossectional views of the FIG. 2 single cylinder, two-cycle engine-electric motor/generator combination at plane 1*c*.

FIG. 2 is a cross-sectional view of said FIG. 1*c* engine-generator at plane 2.

Figure 3A:
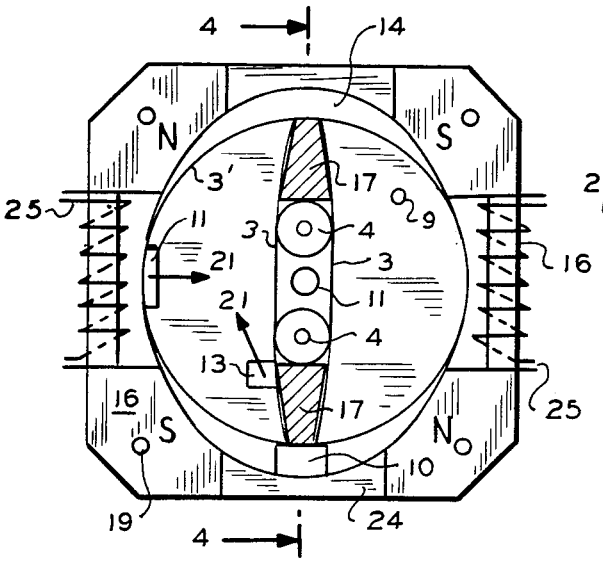
FIGS. 3*a* and *b* are cross-sectional views of the FIG. 4 (rotors offset by 90°) double cylinder, two-cycle engine-generator at planes 3*a* and 3*b*.

Said simplified drawings illustrate schematically the outskirts of the present invention, and the numerals 1–25 therein refer to similar parts throughout the specification. They are collectively defined as follows: 1=shaft, 2=rotor, 3=flexible sheet, 4=roller, 5=roller-support, 6=spring, 7=spring-support, 8=fuel injector, 9=glow- or sparkplug, 10=exhaust port, 11=intake port, 12=inlet (swing check) valve, 13=gas duct, 14=cooling duct, 15=colling fins, 16=electromagnet, 17 permanent magnet, 18=commutator, 19=screw, 20=cable, 21=gas flow, 22=exhaust flow, 23=cable movement, 24=housing, 25=electromagnet's wiring.

If not indicated otherwise, all gas and/or electrically powered first rotors, depicted herein, rotate clock-wise.

DESCRIPTION OF THE PREFERRED EMBODIMENTS

FIGS. 1*a* to *d* and 2 depict an electric motor/generator whose rotor 2 is a (somewhat leaner or flatter) electromagnet 16, which has been augmented, according to this invention, with the flexible sheet 3. Its housing (stator) 24 contains a pair of permanent magnets 17, and the other pair is substituted by the rollers 4, which are variably pressed onto the sheet's outer surface by the springs 6, resting at their supporters 7, which in turn are moveable by the cable 20 (not shown in FIGS. 1*b–d*) in direction 21. FIG. 1*a* shows the flexible cylinder, equally partitioned by the rotor 2, in the ignition position (top right, with activated fuel injector 8 and spark plug 9) and exhaust position (lower left) showing a communication between the exhaust port 10 and intake port 11 via the cooling ducts 14. Air is being blown in direction 21 through the (spring-loaded) one-way valves 12 into the motor/generator's cavity, occupied by the rollers 4 and their supporters 5 also, which air partly escapes via the gas duct 13, cooling duct 14, and exhaust port 10. FIG. 1*b* shows the rotor 2 closing the exhaust port 10, and opening of the intake port 11, while the flexible cylinder's chambers are expanding, and the flexible sheet 3 is compressing the air within said cavity, thereby closing the valves 12. Said air is moving via duct 13 and intake port 11 into the left, semicylindrical chamber. FIG. 1*c* depicts the end of the power and intake stroke, and FIG. 1*d* half of the compression and exhaust stroke removing combustion products in direction 22 (upper and lower semicylinders respectively), so that after a single revolution said events are repeated, like in a two-cycle engine, with actually four cycles performed. Due to the fact that compression and exhaust strokes require different forces acted upon the rollers 4 and flexible sheet 3, the upper springs 6 may be stiffer than the lower. In order to facilitate an easy start-up of this engine-generator combination, at least said stiffer springs' support 7 is telescoped out of the housing 24, as shown in FIG. 1*a* by broken lines, when releasing the cable 20 attached thereon, and the motor/-generator is activated by entering current at the commutator 18, shown in FIG. 2. It also depicts the conventional assembly of this engine-generator from stamped sheets, which is currently the cheapest method of manufacturing complex, rigid bodies. Accordingly, a stack of soft iron plates, separated by Eddy-insulators and cooling fins 15, forms the housing 24, steel or duralumin are chosen for the flexible cylinder's end-plates with stamped-out exhaust and intake ports 10 and 11, as well as openings for the bearings of the shaft 1, injectors 8 and spark plugs 9. Said stack, also confining the ducts 13, is held together by the four screws 19, and augmented with the permanent magnets 17, light metal rollers 4, their supports 5, springs 6, and their supports 7 respectively. The spring-cavity within the housing 24 also contains the inlet valves 12, which are in communication with the inlet ports 11 via the ducts 13. As mentioned before, this engine-generator is started by energizing its rotor 2, i.e. the electromagnet 16, symbolized in FIGS. 1*c* and 2 with some copper or aluminum wire 25 terminating in the commutator 18, drawing current from a battery (not shown). Its rotational speed or torque is regulated by both the fuel- and air-quantity within the flexible semicylinders, whose volume is manipulated by the cable 20, terminating in the gas pedal (not shown), as explained above for the start-up, i.e. the least engine-torque (but most electrical torque) is obtained when the upper spring-support 7, shown in FIG. 1*a*, is in the extended position (broken lines, gas pedal up and fuel injector 8 almost closed), and the most torque is obtained when the sheet 3 and roller 4 are at the closest radial distance from the shaft 1 (solid lines, gas pedal floored and fuel injector opened). Since air from two of the housing's cavities (wherein the rollers 4 are located) enters, via duct 13 and port 11, into only one flexible semicylinder per revolution, the proper dimensioning of the former, as well as of the rollers 4, valves 12 and ports 10, 11, will compensate for the low compression ratio achieved with this embodiment of the invention.

Figure 3B:
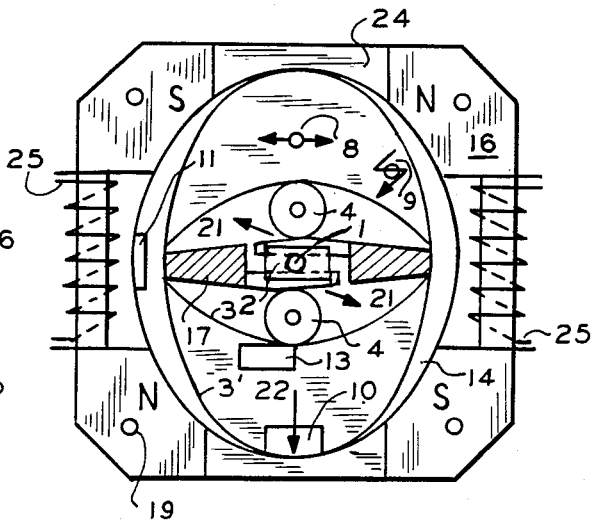

FIGS. 3*a*, *b* and 4 depict an even simpler and faster running reciprocal version of the former engine-generator, wherein two flexible sheets 3 and 3', attached to the rotor 2, are flexed by the rollers 4, mounted at their supporters 5 within a glide-bearing (V-guide) in the end-plate of the housing 24. The latter comprises two electromagnets 16, whose poles are connected by non-ferrous spacers, and the oval, cylindrical cavity thus formed, provides sufficient space for the flexible double cylinder therein, as well as the cooling ducts 14, drawing air via the ports 10 and 11. FIG. 3*a* shows the most expanded (least deformed) flexible double cylinder formed from the sheets 3 and 3', and the penultimate end-plates of the housing 24, at the end of its power stroke (right semicylinder) and intake stroke (left semicylinder), when air enters in direction 21 from the housing's cavity (air ducts 14) through the intake port 11, as well as from the inner flexible cylinder through the duct 13. FIG. 3*b* shows the most deformed double cylinder at the end of its compression (upper) and exhaust stroke (lower half), when the combustion gases escape in direction 22 through port 10, and fresh air enters in direction 21 through the one-way valve 12 into said inner cylinder formed by the flexible sheet 3. The latter forces the L-shaped halves of the rotor 2 and the permanent magnets 17 (the shorter sides of them are gliding or telesocping via V-guides into each other) into their closest position, activating both injector 8, and spark plug 9, within said cylinder's (penultimate) end-plates also. The start-up of this engine-generator is again facilitated by releasing the cables 20, moveable in directions 23 and attached at the roller supports 5, so that the sheet 3 moves the rollers 4 at the V-guided supports 5 into their closest position (not shown), thus minimizing the flexing of said double cylinder, or the required torque of the starter motor (composed of the magnets 16 and 17, the rotor 2, shaft 1, and commutator 18) respectively. At full rotational speed the tension of cables 20 is increased by the gas pedal, whereby the roller-supports 5 (gliding within the housing's end-plates) are moving apart, thus increasing the outward compression ratio in turn. The injected fuel, ignited by the spark plug 9, expands the upper semicylinder of FIG. 3*b*, i.e. activates the engine part of this combination, and any backsliding of the rollers 4 during the power stroke is prevented by a counter-acting spring or inertial mass between cables 20 and the gas pedal, e.g. by rolling said cables around a heavy spool. While running on fuel, the electromagnets 16 return current, via the wiring 25 and the commutator 18, to the battery. This engine-generator my also be cooled by either forcing air through the ducts 14, e.g. by a propeller or turbine blade attached to shaft 1, and/or by cooling fins inserted between the housing's soft iron sheets, as described for the FIGS. 1 and 2 design.

DESCRIPTION OF EQUIVALENT EMBODIMENTS

Figure 4:
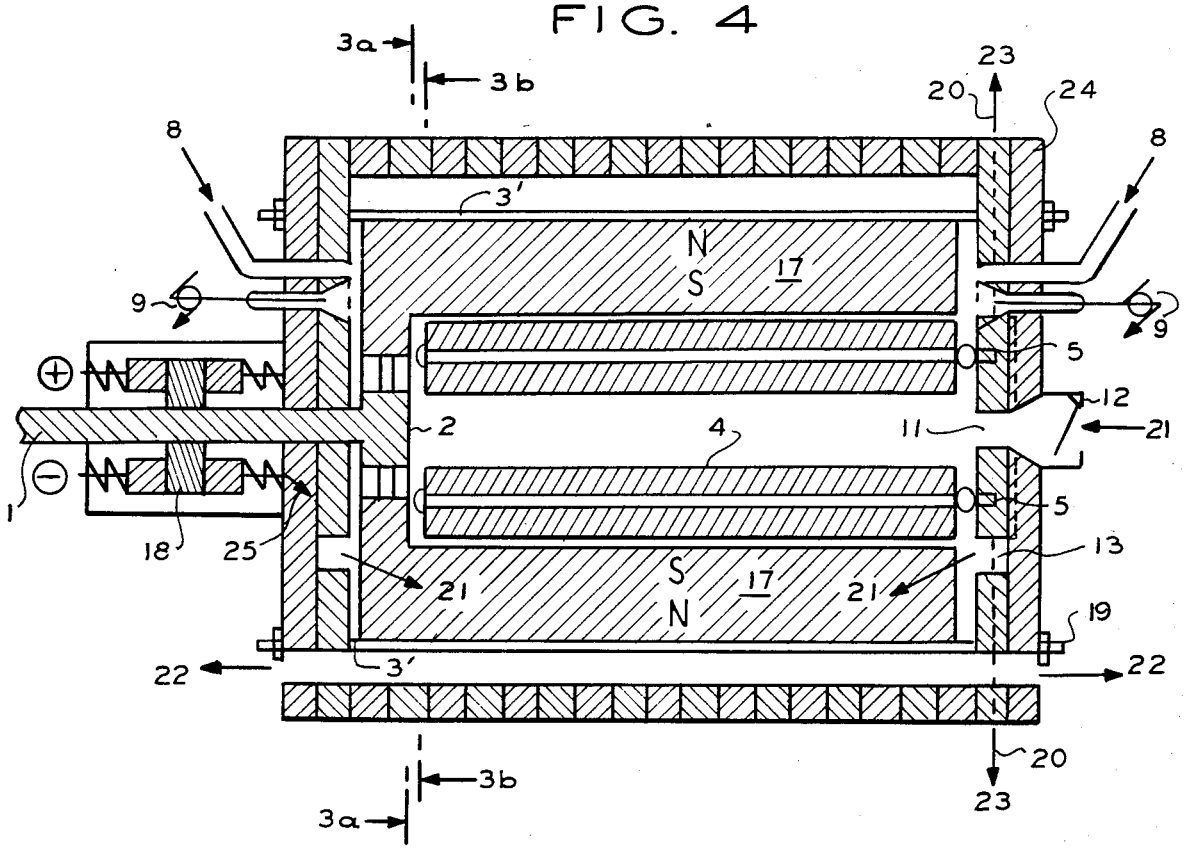
FIG. 4 is a cross-sectional view of said FIG. 3*a* engine-generator at plane 4.

Having described and schematically depicted (for clarity and graphical simplicity) a few specific, most exemplary embodiments of this invention, the following lists some of the obvious equivalents or derivations thereof. Thus, for example, in the FIGS. 3, 4 engine generator, both long rollers 4 and their supporters 5 may be substituted by two pairs of much shorter rollers (ballbearings) attached to protruding shafts embedded in the S-poles of the permanent magnets 17 each, and running in oval channels within the plates contacting the flexible sheets 3 and 3'. This alteration greatly increases the volume of the inner flexible cylinder (air-charging the upper, powering semicylinder), and the stability of the whole combination as well, because two rotors 2, at shafts 1, may carry the usually brittle magnets 17, when displacing the central intake port 11 and valve 12 slightly off-center. Moreover, two ducts 13 and ports 11 may be punched out of said plates symmetrically, instead of port 10, so that both semicylinders are utilized for power strokes, and the ports 11 for the exhaust, whereby this engine-generator modification runs in a true two-cycle fashion, i.e. with simultaneous exhaust through 11, and intake through 13.

Since every motor may be utilized as the reciprocal generator, the engines according to this invention can also be operated with gases of increased or reduced pressure (relative to atmospheric pressure), and liquids as well, charged to their intake or exhaust ports respectively. Variously, they may be driven like pumps, e.g. by said built-in electric motors, for driving liquids, or generating gas-pressure different from atmospheric pressure, such as in refrigerators or heat-pumps.

Evidently, said equivalent derivations require minor, conventional additions, omissions and/or variations of the parts mentioned herein, or their combinations. Thus, for example, the shape and/or location of most parts depicted herein, has not been chosen for technological superiority, but for visual clarity instead. Accordingly, the shape of the flexed cylinders, composed of the sheet 3 and the contacting plates of the housing-stack 24, rotors 2, rollers 4, supports 5 and 7, springs 6, injectors 8, plugs 9, ports 10 and 11, valves 12, ducts 13 and 14, fins 14, magnets 16 and 17, commutators 18, screws 19, and housings 24, has been simplified, or stylized respectively, and several thereof located at sites with the least obstruction by other parts. However, injectors, plugs, ports and valves may also be located at the rotors 2, attached to hollow shafts 1. Injectors 8 may, of course, be omitted if carbureted air is utilized at low compression ratios. Since the lower and upper explosion limits of air/saturated hydrocarbon mixtures are rather narrow (as compared with hydrogen), it is advantageous to mix the fuel with an insufficient amount of air first, e.g. within a turbomixer, transferring the non-explosive mixture into the flexible cylinder, and finally mixing it there with additional air, so that special cylinder/-rotor/plate configurations (ensuring turbulence) become superfluous. Depending on the rotors' volume, and the flexible sheets' bending, the compression ratio of said engines covers a wide range. Also certain ports 10, 11, and ducts 13, e.g. those of the FIGS. 3, 4 engine, may be substituted by (concave) recesses within the sheet-3-contacting plates, so that compressed air from the housing and/or inner cylinder may enter, or combustion gases escape, through the gap between said recesses and the sheet's edges, thus greatly diminishing the sheet-plate-friction. In this connection it should be noted that any sealing imperfections at the sheet-plate-contacts become negligible at high vibration frequencies, what is one more reason for starting these engines at full rotational speed, as mentioned for FIGS. 1 to 4.

Due to the true technological progress in the chemical and electrical arts, a large number of new materials are available for the few essential parts of the engines according to this invention. Thus, for example, steel has been perfected to such degree that blades therefrom remain highly flexible and durable, even in the form of excessively thin and perforated sheets present in the vibrator-type electric razors, whose drive may, of course, also vibrate the flexible sheets 3 herein, or the FIGS. 3, 4 rotors 2 respectively, e.g. in the 3*b*-position, thereby rendering their rotation, as well as rollers 4 and their gliding supporters 5 superfluous. In the latter equivalent, the poles of the electromagnets 16 are merely moved into closer vicinity of the permanent magnets 17, shown in FIG. 3*b*, e.g. by bending the electromagnets 16 into narrower U-shapes, and energizing them with alternating current of sufficient strength, so that the flexible double cylinder vibrates between the shown oval and circular configurations, but the magnets 17 remain in horizontal position all the time.

Accordingly, stainless steel may be utilized for the flexible sheets 3 and 3' most advantageously. Also non-magnetic materials may be chosen, especially for said engine-generators (in order to maintain the pole-strength of the magnets 16 and 17), such as Teflon-coated duralumin, or even non-metallic composites, such as glass or graphite fiber-Teflon composites, depending on the ventilation of said sheets. Their thermal (linear) expansion must be matched by that of the housing 24, in order to minimize their friction and abrasion at the contacting rigid plates. This task, however, is easily achieved by said manufacture of the housing from a plurality of stamped-out sheets. If, for example, the soft iron sheets utilized for said engine-generator's housing 24, expand differently (at the chosen temperature range) than the duralumin sheet 3, then the interspersed Eddy-insulators, fins 15, and even glass or ceramic sheets or plates, may compensate for the difference.

The rigidity (planarity) of the sheet-3-contacting plates may not only be preserved with larger amounts of material used for them, but also by attaching vertical (crossed) fins 15 thereon, and/or an internal wafer or cell (porous) structure thereof. Variously, a thin steel sheet may be stacked against a thicker magnalium or fibrous ceramic (Eternit) plate. In case the rotors 2 are utilized for the opening and closing of ports 10, 11 and ducts 13 within said plates, their frictional contact thereon, and similar thermal expansion with the sheet 3, is necessary also. Therefore, the rotors' stacking from sheets or larger subunits, will be necessary as well. The rotor-2-sheet-3-connection may be achieved with bolts, via spot-welding, or the bending of the sheet's opposite edge-portions to about 90° relative to its larger faces, and inserting them into corresponding slits within the rotor's terminal portions, thus avoiding disconnections or bolt-loosenings at the sheet/rotor interface, or reduced stress respectively.

If not mentioned already, the engines according to this invention are constructed of any suitable and cheap material utilized for purpose-similar parts, and by conventional engineering techniques. The method of operating them is similar to that disclosed by N. A. Otto in U.S. Pat. No. 194,047 (column 4). It may be improved, however, for the FIGS. 3, 4 engine thus: Assuming in FIG. 3*a* the right, flexible semicylinder at the end of the outstroke (powerstroke), and about to be moved through its instroke by the momentum of the rotor-2-magnet-17-combination, then the left semicylinder is in a position to admit carbureted (not yet explosive) air through port 11, and preheated fresh air through duct 13 from the inner, almost collapsed flexible cylinder composed of sheet 3, thereby bringing said carbureted air within its explosion limits. Now the commutator 18 admits current (from the battery) into the electromagnets 16 at low rotational speed, inducing attracting S-poles, and repelling N-poles therein, so that the rotor 2 is moved, by the action of its permanent magnets 17, with terminal N-poles, through its instroke into the position depicted by FIG. 3*b*, i.e. the most flexed position of the double cylinder, compressing the carbureted air in the upper, expelling combustion gases in the lower, and admitting fresh air through valve 12 into the middle chamber thereof. If desired, additional fuel is introduced by injector 8 into the upper (cold) semicylinder, and the explosive mixture therein ignited by the spark plug 9, which is also activated by commutator 18 at about its position alternating polarity within magnets 16, the latter of which may also carry the induction coil for plug 9. Ignition causes a gradual development of heat and expansion of gases in said upper semicylinder (the corresponding wave-fronts traveling towards each other), which initiate its outstroke, imparting momentum to the rotor 2, if desired in phase with said electric pole-attraction and repulsion at low rpm-values. Before said double cylinder reaches the FIG. 3*a* position, fresh air from the middle chamber enters into the lower, left semicylinder via duct 13, thereby flushing combustion gases from the previous cycle out through port 10. At high rpm-values, the commutator 18 may be disconnected from the battery (and the electricity, generated in the magnets 16, consumed by other equipment, e.g. driving motors of vehicles), and the injectors 8 shut as well.

The power of said engines may be regulated conventionally by the quantity of combustible fuel injected by 8 at each charge, but also by the volume of fresh air drawn into the flexible cylinders via ports 11, valves 12 and ducts 13. This is achieved, either by increasing or decreasing the opening resistance of the inlet valves 12, e.g. by a spring thereon, which is connected to the gas pedal by lever or cable, or by moving the roller-4-supporters 5 via cables 20 in directions 23, thereby increasing or decreasing the flexible sheet's 3 distance from shaft 1, or the flexible cylinder's air-volume respectively, as described earlier for the start-up.

Although cool, preferably water-saturated air enters the housing 24 through the ports 10, 11, valves 12 and/or ducts 14 at twice the rate necessary for combustion within the flexible cylinders, it may not cool the sheets 3 and 3' sufficiently when vibrating at high frequencies. Therefore, additional blowers may ventilate said housing 24, or ducts 14, in conventional manner. Said cooling ducts 14 are advantageously connected with the lubrication system also, for providing a smooth gliding of the sheet-3-edges along the contacting plates of the housing 24. Moreover, electromagnets and permanent magnets 16 and 17 may be interchanged, added or omitted.

What is claimed is:

1. An engine comprising: a housing, a shaft connected to a rotor, both rotatably mounted on said housing and extending in its longitudinal axis, at least one flexible sheet so attached to said rotor that a radial distance between its curved surface and said axis is maintained, a pair of parallel end plates mounted on said housing perpendicular to said axis and contacting said sheet's end surface, thereby forming chambers within the boundaries of said housing, sheet and plates, inlet and exhaust means within either of said end plates, a roller attached to said housing and contacting said sheet's curved surface at radial distances smaller and up to said chambers' maximum radius, thereby varying their volume, and means for igniting combustible mixtures within one of said chambers.

2. An engine according to claim 1, wherein two flexible sheets are so attached to said rotor that the radial distance between said axis and the one sheet's curved surface is smaller than the distance between said axis and the other sheet's curved surface.

3. An engine according to claim 2, wherein a pair of rollers contacts the inner, curved surface of that sheet with the smaller radial distance from said axis.

4. An engine according to claim 3, wherein said pair of rollers is slideably attached to one of said plates mounted on said housing, so that the rollers' distance from each other is variable.

5. An engine according to claim 2, wherein said rotor is composed of two L-shaped halves, the longer parts of which are attached to said sheets and the shorter parts are telescoping into each other relative to said axis.

6. An engine according to claim 1, wherein said inlet means comprises a swing check valve admitting said combustible mixture into that chamber with said sheet-plates boundaries.

7. An engine according to claim 1, wherein said igniting means is a spark plug.

8. An engine according to claim 1, wherein said combustible mixtures comprise air/saturated hydrocarbon mixtures.

9. An engine according to claim 1, wherein said inlet means comprises a fuel injector.

10. An engine according to claim 1, wherein said housing is an electromotor/generator's stator having said plates attached to opposite sides thereof, thereby housing said rotor, sheet and roller.

11. An engine according to claim 10, wherein said rotor is attached to an electrical commutator, which is functionally wired to said stator's electromagnets.

12. An engine according to claim 10, wherein said rotor is composed of a pair of permanent magnets.

* * * * *